US007804474B2

(12) United States Patent
Chen et al.

(10) Patent No.: US 7,804,474 B2
(45) Date of Patent: Sep. 28, 2010

(54) OVERDRIVING CIRCUIT AND METHOD FOR SOURCE DRIVERS

(75) Inventors: Ming-Yeong Chen, Tainan (TW); Yao-Hwei Lee, Tainan (TW)

(73) Assignee: Himax Technologies Limited (TW)

( * ) Notice: Subject to any disclaimer, the term of this patent is extended or adjusted under 35 U.S.C. 154(b) by 1127 days.

(21) Appl. No.: 11/427,264

(22) Filed: Jun. 28, 2006

(65) Prior Publication Data

US 2008/0002912 A1 Jan. 3, 2008

(51) Int. Cl.
*G09G 3/36* (2006.01)

(52) U.S. Cl. ..... 345/98; 345/89

(58) Field of Classification Search ..... 345/87–111, 345/204–215, 690–699; 315/169.1–169.2
See application file for complete search history.

(56) References Cited

U.S. PATENT DOCUMENTS

2002/0196218 A1* 12/2002 Ham ..... 345/87
2006/0290638 A1* 12/2006 Kang et al. ..... 345/98

* cited by examiner

*Primary Examiner*—Chanh Nguyen
*Assistant Examiner*—Long Pham
(74) *Attorney, Agent, or Firm*—Baker & McKenzie LLP

(57) ABSTRACT

The present invention provides an overdriving circuit for source drivers to overdrive a LCD module. The overdriving circuit includes a first threshold detection logic unit, a second threshold detection logic unit, and a selection logic unit. The first threshold detection logic unit receives gray scale data from an overdriving timing controller, compares the gray scale data to a first predetermined gray scale value, and outputs a first control signal. The second threshold detection logic unit receives the gray scale data, compare the gray scale data to a second and a third predetermined gray scale values, and outputs a second control signal. The selection logic unit receives the gray scale data, receives a plurality of gray scale compensation data, and outputs one of the received data according to the first control signal, the second control signal and a third control signal.

12 Claims, 6 Drawing Sheets

From

To

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 62 | 16 | 0 | 0 | 0 | 0 | 0 | 0 | 0 | 0 | 0 | 0 | 0 | 0 | 0 | 0 | 0 |
| 32 | 95 | 76 | 32 | 16 | 16 | 16 | 16 | 16 | 16 | 16 | 11 | 8 | 9 | 7 | 0 | 3 | 3 |
| 48 | 132 | 98 | 57 | 48 | 32 | 32 | 32 | 32 | 32 | 28 | 18 | 15 | 11 | 9 | 7 | 5 | 4 |
| 64 | 151 | 120 | 85 | 80 | 64 | 48 | 48 | 48 | 48 | 45 | 40 | 27 | 19 | 25 | 10 | 9 | 7 |
| 80 | 177 | 144 | 113 | 97 | 96 | 80 | 64 | 64 | 64 | 64 | 64 | 52 | 29 | 39 | 19 | 15 | 11 |
| 96 | 188 | 162 | 132 | 124 | 112 | 111 | 96 | 80 | 64 | 80 | 77 | 61 | 60 | 53 | 28 | 22 | 17 |
| 112 | 195 | 175 | 152 | 140 | 131 | 126 | 126 | 112 | 96 | 97 | 96 | 94 | 77 | 67 | 52 | 42 | 30 |
| 128 | 201 | 186 | 167 | 157 | 152 | 148 | 142 | 139 | 128 | 112 | 114 | 115 | 98 | 91 | 82 | 67 | 61 |
| 144 | 209 | 195 | 181 | 174 | 168 | 163 | 159 | 155 | 155 | 144 | 128 | 130 | 129 | 121 | 110 | 91 | 87 |
| 160 | 216 | 203 | 191 | 189 | 185 | 181 | 176 | 173 | 169 | 170 | 160 | 144 | 146 | 144 | 134 | 132 | 118 |
| 176 | 221 | 211 | 202 | 198 | 195 | 192 | 192 | 192 | 186 | 183 | 184 | 176 | 160 | 160 | 160 | 153 | 146 |
| 192 | 229 | 223 | 214 | 213 | 209 | 208 | 208 | 207 | 205 | 203 | 201 | 199 | 192 | 177 | 184 | 179 | 173 |
| 208 | 238 | 231 | 226 | 224 | 224 | 224 | 223 | 222 | 220 | 219 | 217 | 216 | 213 | 208 | 192 | 194 | 193 |
| 224 | 245 | 241 | 240 | 240 | 239 | 239 | 237 | 236 | 235 | 234 | 233 | 232 | 230 | 228 | 224 | 208 | 213 |
| 240 | 255 | 255 | 253 | 252 | 252 | 251 | 251 | 250 | 249 | 248 | 248 | 247 | 246 | 245 | 244 | 240 | 224 |
| 255 | 255 | 255 | 255 | 255 | 255 | 255 | 255 | 255 | 255 | 255 | 255 | 255 | 255 | 255 | 255 | 255 | 255 |

FIG.1(Prior Art)

0 : Gray Scale Data
1 : Vext_H(-)
2 : Vext_H(+)
3 : Vext_L(-)
4 : Vext_L(+)

OVERDRIVING CIRCUIT AND METHOD FOR SOURCE DRIVERS

BACKGROUND OF THE INVENTION

1. Field of the Invention

The present invention relates to a compensation circuit and method, and in particular certain embodiments of the present invention relate to an overdriving circuit and method for source drivers to overdrive thin film transistors (TFTs) in a liquid crystal display (LCD) module.

2. Description of the Prior Art

As a result of smaller volume and less power consumption, flat-panel displays, such as liquid crystal displays (LCDs), have been gradually replacing cathode ray tube (CRT) displays and becoming the mainstream in the field of display devices, for example, LCD monitors, LCD televisions, and so forth. However, because of the characteristics of the molecules of the liquid crystal material, a motion blur phenomenon occurs when LCD devices are used to display high speed dynamic images or videos.

There are two common methods familiar to those skilled in the art to eliminate the motion blur phenomenon. The first method is referred to as "capacitance coupling" and the second method is referred to as "overdriving". According to the capacitance coupling method, a circuit can be altered to meet the requirement mentioned above, but it is unable to compensate for a rising signal and a falling signal at the same time. Further, the circuit under the capacitance coupling method can not compensate for each pixel. On the other hand, the overdrive method requires more complex circuitry than the capacitance coupling circuitry. The overdrive method requires frame buffers and does not have the limitations of the capacitance coupling method. The overdrive method can use unmodified control circuits and driving circuits.

Referring to FIG. 1, a look up table (hereinafter "LUT") typically used by source drivers to overdrive a LCD module is illustrated. In this example, a given source driver has 8-bit data so it can drive $2^8$=256 (0-255) gray scale levels. The LUT shows overdrive gray scale values based on the current gray scale value of a pixel and the desired (next) gray scale value of that pixel. The first row (i.e., the horizontal axis) represents the starting gray scale value of a pixel before a change of data from a source driver, whereas the left-hand column (i.e., the vertical axis) represents the ending gray scale value of the pixel after the change of data. For example, according to the LUT shown in FIG. 1, when it is desired to change a pixel from gray scale level 0 to gray scale level 128, the source driver should overdrive the gray scale of the pixel to gray scale level 201 rather than gray scale level 128. For another example, when it is desired to change a pixel from gray scale level 255 to gray scale level 128, the source driver should overdrive the gray scale level of the pixel to gray scale level 61 rather than gray scale level 128.

However, it will be apparent to those skilled in the art that overdriving is limited for some "from-to" value pairs shown in the LUT of FIG. 1. For example, when it is desired to change a pixel from gray scale level 0 to gray scale level 255, the source driver would preferably overdrive the gray scale level of the pixel to a gray scale level higher than 255. The source driver in the present example, however, can only provide 256 (0-255) gray scale levels because it is limited to 8-bit data. That is, gray scale level 255 is the maximum gray scale level the 8-bit source driver can provide. The same is true for other "from-to" value pairs, such as from gray scale level 16 to 255, from gray scale level 32 to 255, etc. Similarly, when it is desired to change a pixel from gray scale level 255 to gray scale level 0, the source driver would preferably overdrive the gray scale level of the pixel to a value less than gray scale level 0. In this example, however, gray scale level 0 is the minimum gray scale level possible. A similar problem exists where a pixel's gray scale level is changed to lower values, such as from gray scale level 240 to 0, from gray scale level 224 to 0, and the like. Accordingly, the overdriving of a pixel will deteriorate when changing to higher values, such as more than gray scale level 240, and/or when changing to lower values, such as less than gray scale level 16.

One of the methods for solving the foregoing problem is to employ 9-bit source drivers, so that the gray scale of a pixel not only can be overdriven to values higher than 255 for desired gray scale values from 240 to 255, but also can be overdriven to the values lower than 0 for desired gray scale values from 16 to 0. This is because the 9-bit source driver can provide $2^9$=512 values for the use of 256 gray scales. The extra bit can be used to transmit the compensation data for those gray scale values smaller than 16 and/or higher than 240. However, each 9-bit source driver requires a 9-bit digital-to-analog converter (DAC) which complicates the design of the circuit, makes the die size larger, increases operating voltage, and increases the cost of the chip.

SUMMARY OF THE INVENTION

Certain embodiments of the present invention are directed to an overdriving circuit in which source drivers overdrive a LCD module. The overdriving circuit includes first threshold detection logic, second threshold detection logic, and a selection logic. According to one embodiment of the present invention, the first threshold detection logic receives gray scale data from an overdriving timing controller, compares the gray scale data to a first predetermined gray scale value, and outputs a first control signal. The second threshold detection logic receives the gray scale data. compares the gray scale data to a second and third predetermined gray scale values, and outputs a second control signal. The selection logic receives the gray scale data, receives a plurality of gray scale compensation data, and outputs one of the received data based on the first control signal, the second control signal and a third control signal.

Certain embodiments of the present invention relate to an overdriving method for source drivers to overdrive a LCD module, comprising: receiving gray scale data from an overdriving timing controller; comparing the gray scale data with a first predetermined gray scale value, and then outputting a first control signal; comparing the gray scale data with a second and third predetermined gray scale values, and then outputting a second control signal, wherein the second control signal is at logical high when the gray scale data is larger than the second predetermined gray scale value or when the gray scale data is smaller than the third predetermined gray scale value, and wherein the second control signal is otherwise at logical low; and selecting the output data from the gray scale data and a plurality of gray scale compensation data.

BRIEF DESCRIPTION OF THE DRAWINGS

FIG. 1 depicts a well-known LUT used by source drivers for overdriving a LCD module:

DETAILED DESCRIPTION OF THE PREFERRED EMBODIMENTS

Some embodiments of the present invention will be described in greater details herein However, it should be noted that the present invention can be practiced in a wide range of other embodiments besides those explicitly described, and the scope of the present invention is expressly not limited except as specified in the accompanying claims.

Moreover, some details are not drawn in order to make the illustrations concise and to provide a clear description for easier understanding of the present invention.

Figure 2:
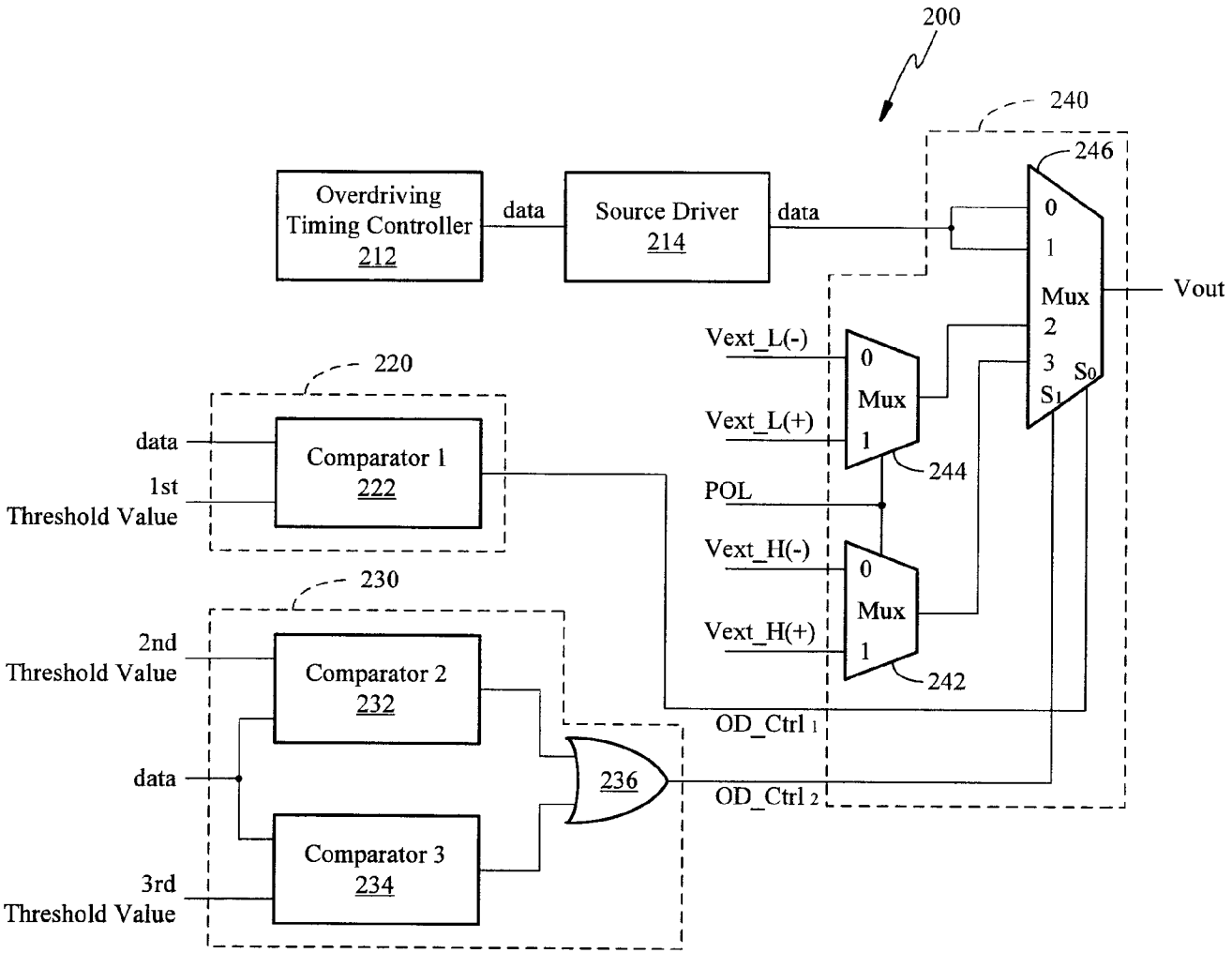
FIG. 2 is a circuit diagram according to one embodiment of the present invention.

Referring to FIG. 2, a circuit diagram according to one embodiment of the present invention 200 is illustrated. A first threshold detection logic 220 receives gray scale data conveying a gray scale value associated with a pixel from an overdriving timing controller 212 (also known as "TCON") and a first predetermined gray scale value labeled "1st Threshold Value." The first threshold detection logic 220 compares the gray scale data with the first predetermined gray scale value and then outputs a comparison result as a first control signal $OD_Ctrl_1$. For example, the first threshold detection logic 220 outputs a first level signal, e.g., logic "1", as the first control signal $OD_Ctrl_1$ when the gray scale data is larger than the first predetermined gray scale value, otherwise it outputs a second level signal, e.g. logic "0", as the first control signal $OD_Ctrl_1$. For example, given 8-bit gray scale data, the first predetermined gray scale value could be set at gray scale value 240, and thus the first threshold detection logic 220 outputs logic "1" when the gray scale data is higher than 240. Alternatively, the first threshold detection logic 220 outputs the second level signal, such as logic "0", as the first control signal $OD_Ctrl_1$ when the gray scale data is smaller than the first predetermined gray scale value. With 8-bit gray scale data, the first predetermined gray scale value could be set at 16, and hence the first threshold detection logic 220 would output logic "0" when the gray scale data is smaller than 16. In these embodiments, the first predetermined gray scale value could be built-in or stored in the first threshold detection logic 220. The first threshold detection logic 220 could be a first comparator 222 and the first control signal $OD_Ctrl_1$ can be used to control the final output data.

A second threshold detection logic 230 receives the same gray scale data, and receives a second and third predetermined gray scale values designated "2nd Threshold Value" and "3rd Threshold Value." The second threshold detection logic 230 compares the gray scale data with the second and third predetermined gray scale values, and then outputs a second control signal $OD_Ctrl_2$ according to the results of the comparisons. For example, the second threshold detection logic 230 outputs a second control signal $OD_Ctrl_2$, such as logic "1", when the gray scale data is larger than the second predetermined gray scale value or smaller than the third predetermined gray scale value, otherwise it outputs an inactive signal, such as logic "0". For example, given 8-bit gray scale data, the second and the third predetermined gray scale values can be respectively set to 240 and 16, and therefore the second threshold detection logic 230 outputs logic "1" when the gray scale data is larger than 240 or is smaller than 16; otherwise, the second threshold detection logic 230 outputs "0" when the gray scale data is between the values 16 and 240. The second threshold detection logic 230 includes a second comparator 232, a third comparator 234, and an OR gate 236. The second comparator 232 compares the gray scale data with the second predetermined gray scale value, and then outputs a first logical high signal (i.e., logic "1") if the gray scale data is larger than the second predetermined gray scale value. The third comparator 234 compares the gray scale data with the third predetermined gray scale value, and then outputs a second logical high signal if the gray scale data is smaller than the third predetermined gray scale value. The OR gate 236 receives the outputs of the second and the third comparators 232, 234, executes a logical "OR" operation, and outputs the result as the second control signal $OD_Ctrl_2$. In this embodiment, the second and the third predetermined gray scale values could be built-in or stored in the second threshold detection logic 230. The second control signal $OD_Ctrl_2$ can be used to control the final output data.

The selection logic 240 receives the gray scale data (via a source driver 214) and a plurality of gray scale compensation data, such as Vext_H(−), Vext_H(+), Vext_L(−), and Vext_L(+). The selection logic 240 uses the first and the second control signals $OD_Ctrl_1$, $OD_Ctrl_2$, and a third control signal POL (polarization signal) as its selection signals for selecting one of received data to output as Vout. Herein, the third control signal POL is provided by the overdriving timing controller 212. The selection logic 240 includes a first multiplexer 242, a second multiplexer 244, and a third multiplexer 246. The first multiplexer 242 receives first and second gray scale compensation data, such as Vext_H(−) and Vext_H(+), and uses the third control signal POL as its selection signal. The second multiplexer 244 receives third and fourth gray scale compensation data, such as Vext_L(−) and Vext_L(+), and uses the third control signal POL as its selection signal. Accordingly, when the third control signal POL is logic "0", the outputs of the first and the second multiplexers 242, 244 are Vext_H(−) and Vext_L(−), respectively; on the contrary, when the third control signal POL is logic "1", the outputs of the first and the second multiplexers 242, 244 are Vext_H(+) and Vext_L(+), respectively. The third multiplexer 246 receives the outputs of the first and the second multiplexers and the gray scale data, and uses the first and the second control signals $OD_Ctrl_1$, $OD_Ctrl_2$ as its selection signals, $S_0$ and $S_1$. Herein, the third multiplexer 246 outputs the gray scale data when $OD_Ctrl_2$ and $OD_Ctrl_1$ are logic "00" or "01"; if $OD_Ctrl_2$ and $OD_Ctrl_1$ are logic "10", then the third multiplexer 246 outputs the output of the second multiplexer 244; and if $OD_Ctrl_2$ and $OD_Ctrl_1$ are logic "11", then the third multiplexer 246 outputs the output of the first multiplexer 242. In this embodiment, the first multiplexer 242 and the second multiplexer 244 are 2×1 multiplexers, and the third multiplexer 246 is a 4×1 multiplexer. The first, second, third, and fourth gray scale compensation data, Vext_H(−), Vext_H(+), Vext_L(−) and Vext_L(+), can correspond to the gray scale levels driven at 0.1 volt (V), 13 V, 5 V, and 7 V, respectively, as default values.

Figure 3:
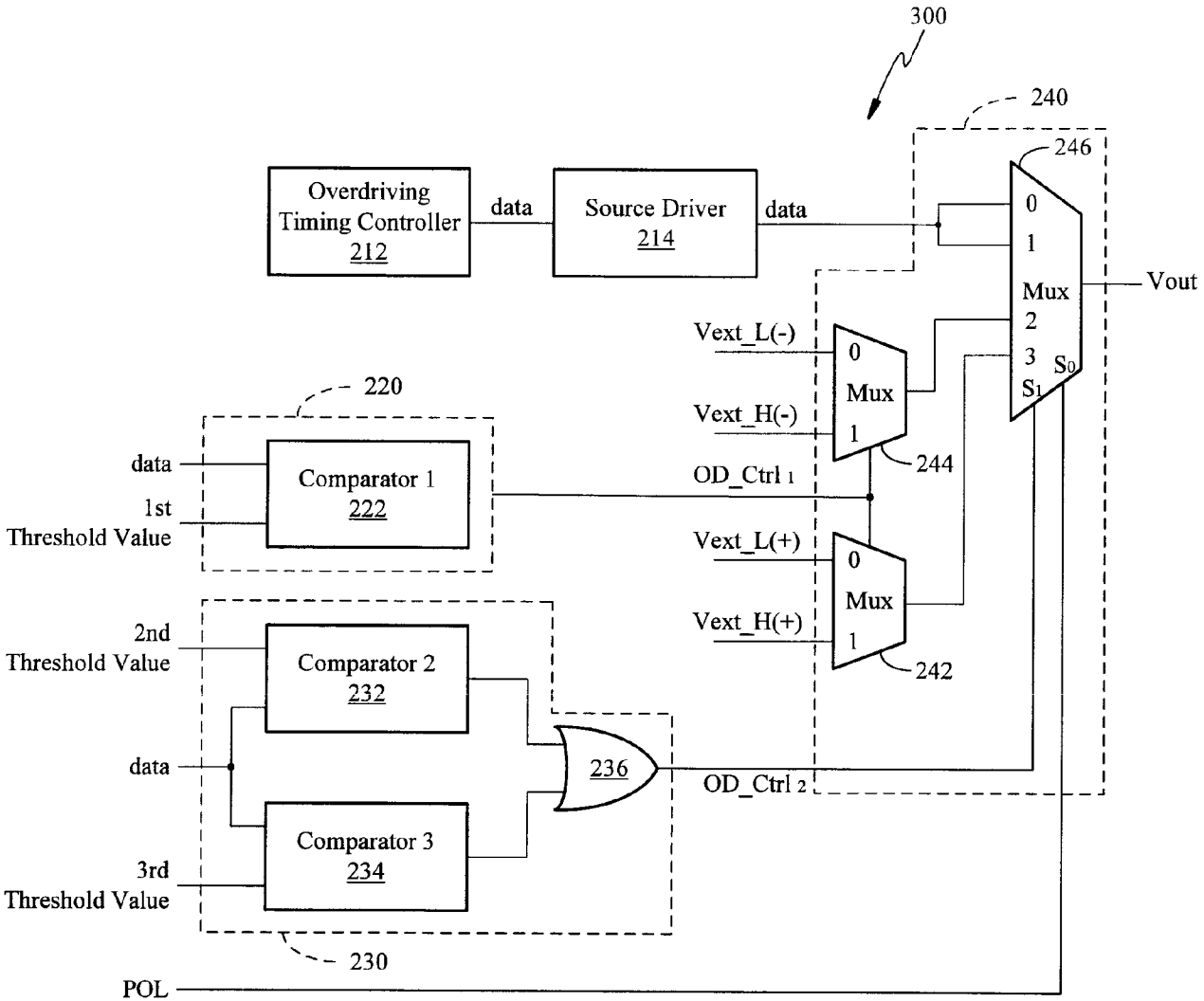
FIG. 3 is a circuit diagram according to another embodiment of the present invention.

FIG. 3 illustrates another embodiment of this present invention. The differences between FIG. 3 and FIG. 2 are the inputs of the first and second multiplexers 242, 244, and the selection signals of the first, second, and third multiplexers 246. The Vext_H(−) signal and the Vext_L(+) are exchanged, and the selection signals of the first and the second multiplexers 242, 244 are changed from POL to $OD_Ctrl_1$. Also, the selection signals, $S_1$ and $S_0$, of the third multiplexer 246 are changed from $OD_Ctrl_2$ and $OD_Ctrl_1$ to $OD_Ctrl_2$ and POL. Thus, the third multiplexer 246 outputs the gray scale data when $OD_Ctrl_2$ and POL are logic "00" or "01"; if $OD_Ctrl_2$ and POL are logic "10", then the third multiplexer 246 outputs the output of the second multiplexer 244; and if $OD_Ctrl_2$ and POL are logic "11", then the third multiplexer 246 outputs the output of the first multiplexer 242. As for other elements shown in FIG. 3, they have the same features and relations with each other as those described in FIG. 2.

Figure 4:
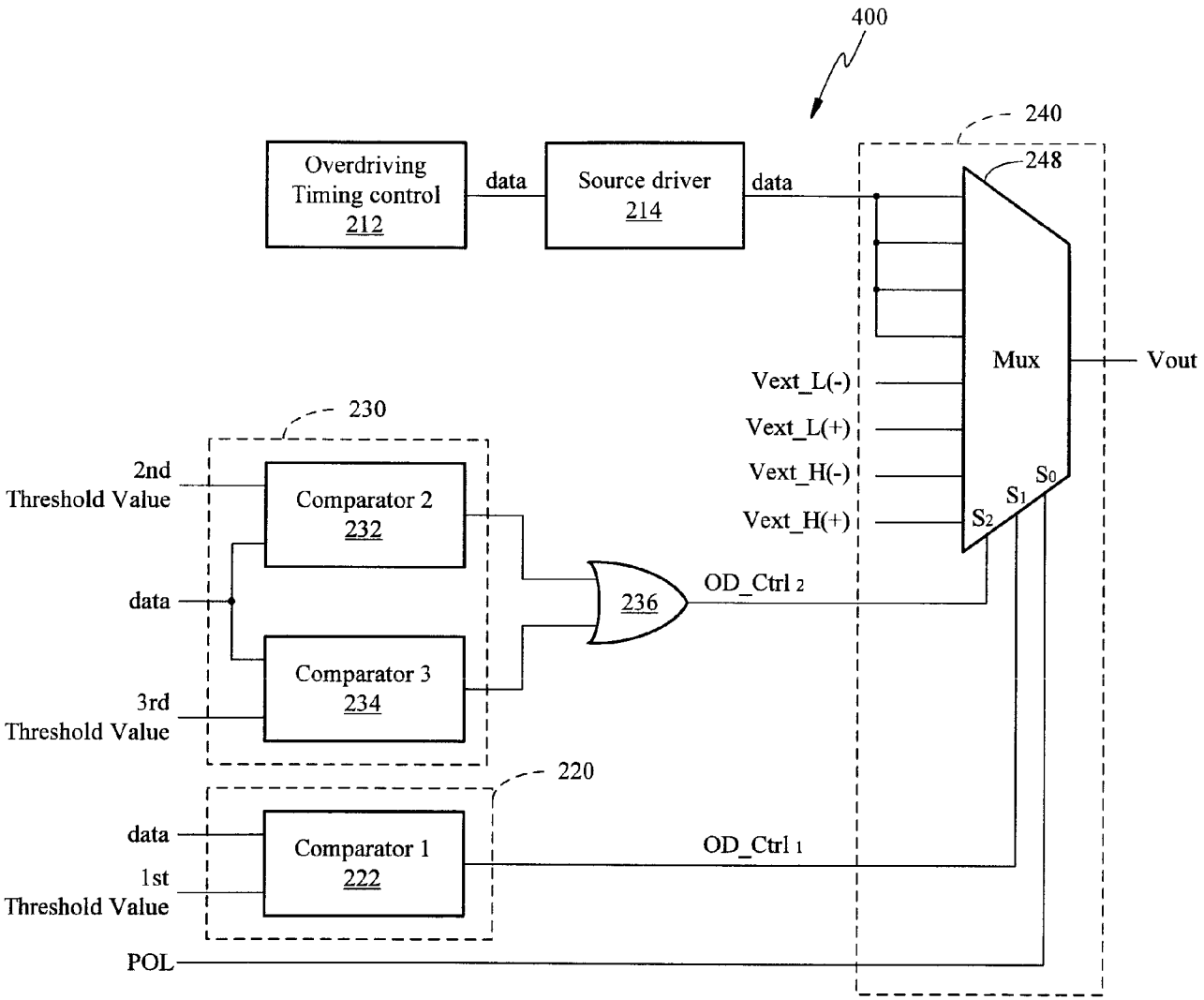
FIG. 4 is a circuit diagram according to another embodiment of the present invention.

FIG. 4 illustrates another embodiment of the present invention. The difference between FIG. 4 and FIG. 2 is the selection logic 240 which comprises an 8×1 multiplexer 248. The 8×1 multiplexer 248 receives the gray scale data and the plurality of gray scale compensation data, Vext_H(−), Vext_H(+), Vext_L(−), and Vext_L(+), and uses the $OD_Ctrl_2$, $OD_Ctrl_1$, and POL, as its selection signals, $S_2$, $S_1$, and $S_0$, respectively. Herein, the selection logic 240 outputs the gray scale data when $OD_Ctrl_2$ is logic "0"; the selection logic 240 outputs Vext_L(−) when $OD_Ctrl_2$, $OD_Ctrl_1$, and POL are logic "100"; the selection logic 240 outputs Vext_L(+) when $OD_Ctrl_2$, $OD_Ctrl_1$, and POL are logic "101"; the selection logic 240 outputs Vext_H(−) when $OD_Ctrl_2$, $OD_Ctrl_1$, and POL are logic "110"; and the selection logic 240 outputs Vext_H(+) when $OD_Ctrl_2$, $OD_Ctrl_1$, and POL are logic "111". As for other elements shown in FIG. 4, they have the same features and relations to each other as those described in FIG. 2.

Alternative embodiments of the present invention are possible. The first threshold detection logic 220 of FIG. 2, 3 or 4 can be left out to simplify the circuit design and to lower the cost, and the original output of the first threshold detection logic 220 to the first control signal $OD_Ctrl_1$ can be replaced by the output of the second comparator 232, i.e. the first control signal $OD_Ctrl_1$ can be coupled to the output of the second comparator 232 (not shown). Alternatively, the second comparator 232 of FIG. 2, 3 or 4 can be left out from the circuit design 200, 300 or 400, and the original output of the second comparator 232 to the "OR" gate 236 can be replaced by the output of the first threshold detection logic 220, i.e. the output of the first threshold detection logic 220 can be coupled to both the first control signal $OD_Ctrl_1$ and the first input of the "OR" gate 236.

Figure 5:
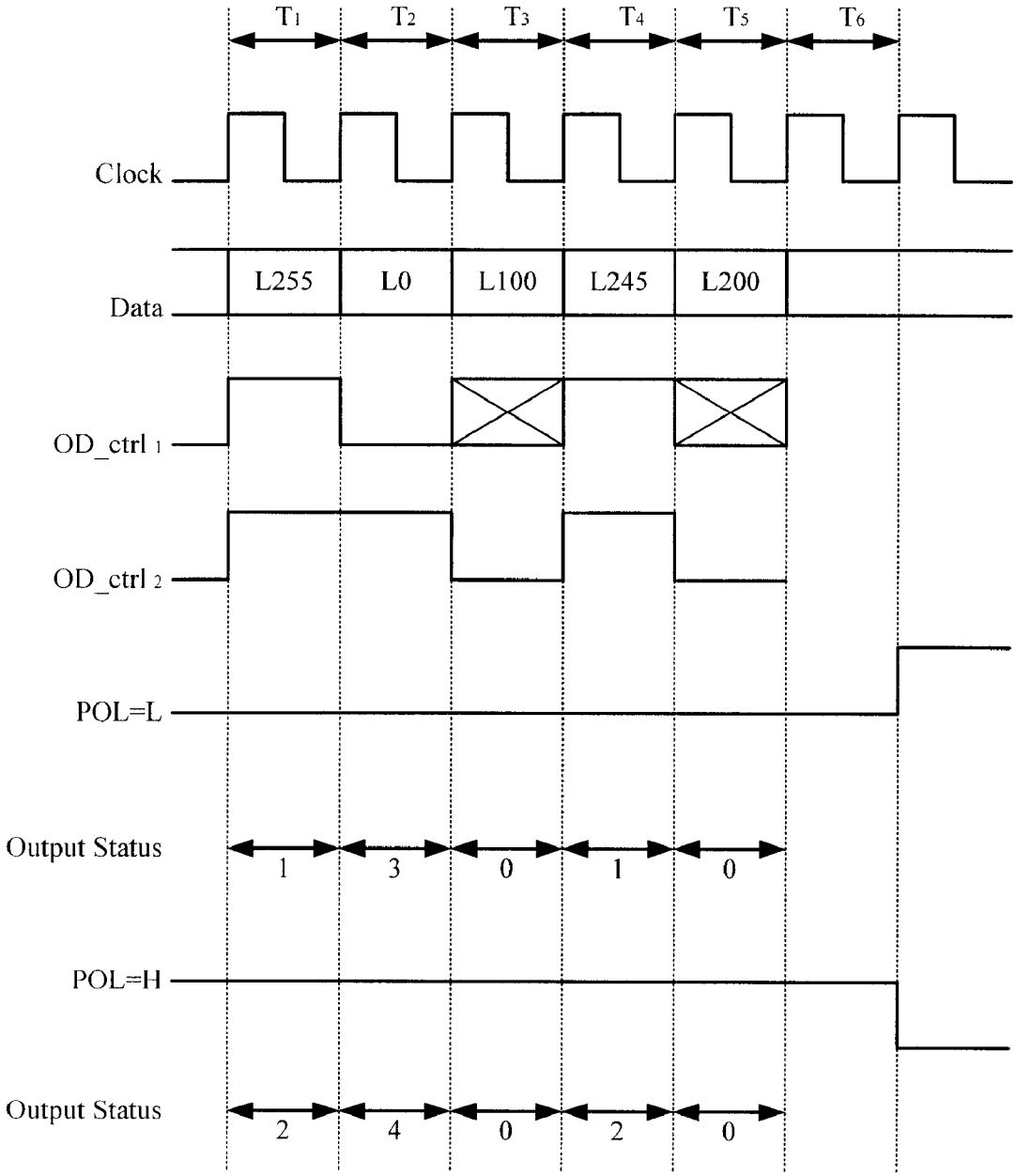
FIG. 5 illustrates the signal-waveforms of the embodiments shown in FIGS. 2, 3, and 4.

Referring to FIG. 5, the signal-waveforms of the embodiments shown in FIGS. 2, 3, and 4 are illustrated. In order to clarify the relationship of the signal-waveforms, the units of the vertical axes (in most cases, voltage) are not shown. The horizontal axis in FIG. 5 represents time. Moreover, it should be understood that the signal-waveforms in FIG. 5 are used to explain the relationships among the gray scale data, the gray scale compensation data, and the control signals. Specifically, the signal-waveforms illustrate when to use and how to select the gray scale compensation data. For example, 8-bit gray scale data (0-255) is used. Referring to FIGS. 2-5, the 1st, 2nd, and 3rd Threshold Values could be respectively set to the values 240, 240, and 16. The outputs of the selection logic 240 (labeled Output Status) are equal to the gray scale data (labeled 0) when the gray scale data is between 16 and 240, such as in $T_3$ (the gray scale data is L100) and in $T_5$ (the gray scale data is L200). Because the gray scale values between 16 and 240 do not need to be compensated for, the second control signal $OD_Ctrl_2$ is logic "0" and therefore the selection logic 240 outputs the gray scale data, regardless of the values of the first and third control signals $OD_Ctrl_1$ and POL.

When the gray scale data is larger than 240, such as in $T_1$ (the gray scale data is L255), both $OD_Ctrl_2$ and $OD_Ctrl_1$ are logic "1", and therefore the Output Status depends upon the POL. The Output Status is equal to the first gray scale compensation data (labeled 1) once the POL is logic "0". The Output Status is equal to the second gray scale compensation data (labeled 2) when the POL is logic "1". Similarly, in $T_4$ (the gray scale data is L245), the Output Status is equal to the first gray scale compensation data (labeled 1) when $OD_Ctrl_2$, $OD_Ctrl_1$, and POL are logic "110",and the Output Status is equal to the second gray scale compensation data (labeled 2) when $OD_Ctrl_2$, $OD_Ctrl_1$, and POL are logic "111". When the gray scale data is smaller than 16, such as in $T_2$ (the gray scale data is L0), $OD_Ctrl_2$ is logic "1" and $OD_Ctrl_1$ is logic "0". Thus, the Output Status depends upon the POL. The Output Status is equal to the third gray scale compensation data (labeled 3) when the POL, is logic "0", and the Output Status is equal to the fourth gray scale compensation data (labeled 4) when the POL is logic "1". In this embodiment, the first (Vext_H(−)), second (Vext_H(+)), third (Vext_L(−)), and fourth (Vext_L(+)) gray scale compensation data can have the default values of the gray scale values driven at 0.1 volt (V), 13 V, 5 V, and 7 V, respectively.

Figure 6:
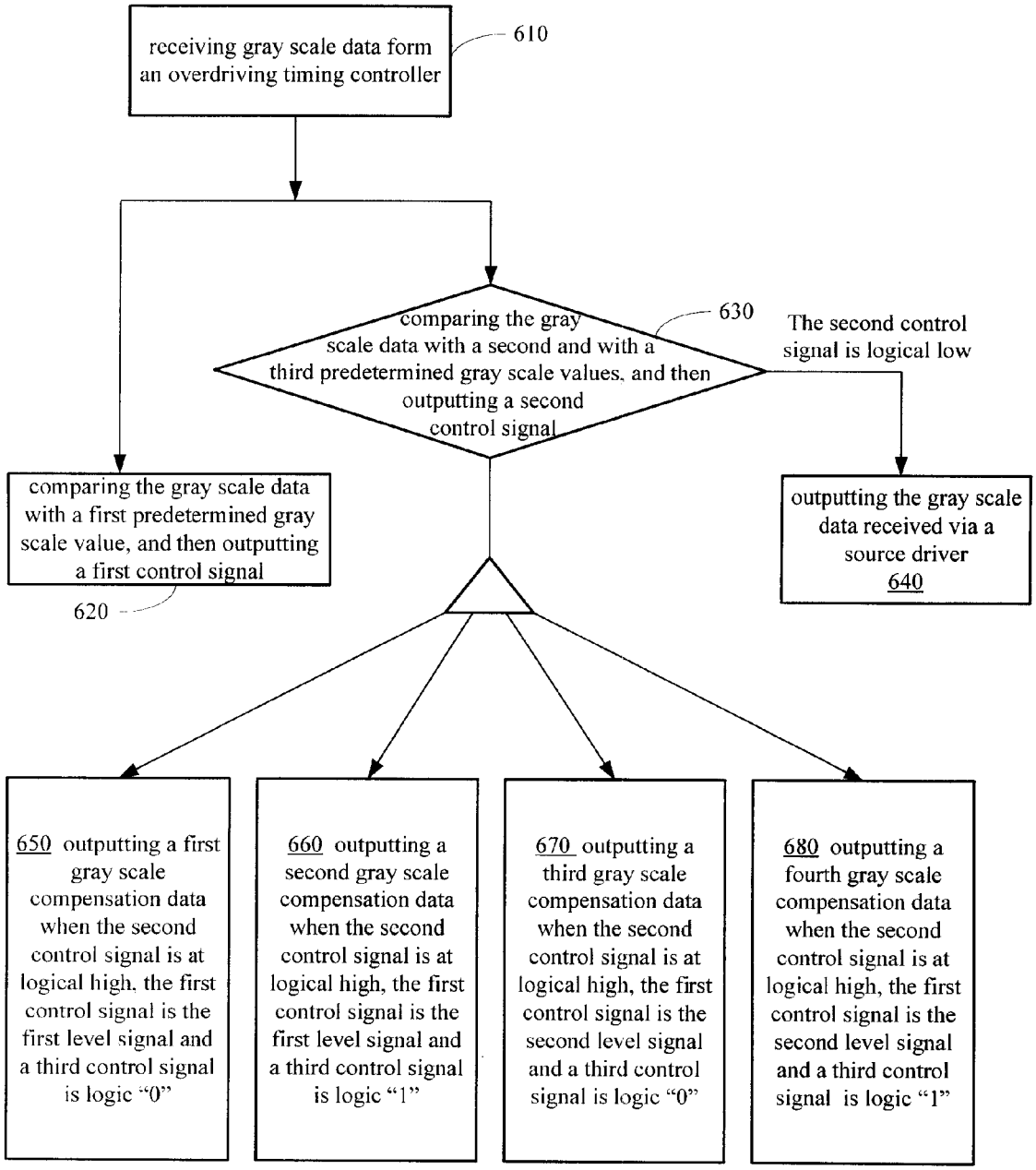
FIG. 6 illustrates a flowchart according to another embodiment of the present invention.

FIG. 6 is a flowchart illustrating another embodiment of the present invention. In step 610, the system receives gray scale data from an overdriving timing controller. In step 620, the system compares the gray scale data with a first predetermined gray scale value, and then outputs a first control signal. Herein the first control signal is set to be a first level signal when the gray scale data is larger than the first predetermined gray scale value, or is set to be a second level signal otherwise. For example, given 8-bit gray scale data (0-255), the first predetermined gray scale value could be set to 240, and thus the first level signal would be outputted if the gray scale data is larger than 240. In step 630, the system compares the gray scale data to the second and third predetermined gray scale values, and then outputs a second control signal. Herein the second control signal is set to logical high if the gray scale data is larger than the second predetermined gray scale value or if the gray scale data is smaller than the third predetermined gray scale value. Otherwise, the second control signal is set to logical low. It will be apparent to those skilled in the art that steps 620 and 630 can be executed simultaneously or combined as one step. When the second control signal is at logical low, step 640 is executed. In step 640, the system outputs the gray scale data received via a source driver. In step 650, a first gray scale compensation data is outputted if the second control signal is at logical high, the first control signal is the first level signal and a third control signal received from the overdriving timing controller is logic "0". In step 660, a second gray scale compensation data is outputted if the second control signal is at logical high, the first control signal is the first level signal and the third control signal is logic "1" In step 670, a third gray scale compensation data is outputted if the second control signal is at logical high, the first control signal is the second level signal and the third control signal is logic "0". In step 680, a fourth gray scale compensation data is outputted if the second control signal is at logical high, the first control signal is the second level signal and the third control signal is logic "1". For example, the first, second, and third predetermined gray scale values could be 240, 240, and 16, respectively. The first, second, third, and fourth gray scale compensation data could be set to default values such as the gray scale values driven by 0.1V, 13V, 5V, and 7 V, respectively.

In accordance with the alternative embodiments of the present invention, either the first or the second predetermined gray scale value can be left out from the circuit design but the steps of generating the first and second control signals ($OD_Ctrl_1$ and $OD_Ctrl_2$, respectively) remain the same. Such embodiments would require corresponding modifications to FIGS. 5 and 6.

The various signals of the present invention are generally "on" (e.g., a logical HIGH, or 1) or "off" (e.g., a logical LOW, or 0). However, the particular polarities of the "on" (e.g., asserted) and "off" (e.g., de-asserted) states of the signals may be adjusted (e.g., reversed) accordingly to meet the design criteria of a particular implementation. Additionally, inverters may be added to change particular polarities of the signals.

Although specific embodiments have been illustrated and described, it will be obvious to those skilled in the art that various modifications may be made without departing from what at is covered by the appended claims.

What is claimed is:

1. An overdriving circuit for source drivers to overdrive a LCD module, said overdriving circuit comprising:

a first threshold detection logic unit configured to receive a gray scale data value associated with a pixel from an overdriving timing controller, compare the gray scale data value with a first predetermined threshold value, and output a first control signal as a result of the comparison between the gray scale data value and the first predetermined threshold value;

a second threshold detection logic unit configured to receive the gray scale data value, compare the gray scale data value with a second predetermined threshold value and to a third predetermined threshold value, and output a resulting second control signal indicative of whether the gray scale data value is within a range between the second and third predetermined threshold value; and a selection logic unit configured to receive the gray scale data value and a plurality of gray scale compensation data, and issue one output data value selected among the gray scale data value and the plurality of gray scale compensation data for driving the pixel according to said first control signal, said second control signal, and a third control signal, wherein said selection logic unit comprises:

a first multiplexer configured to receive a first one and a second one of said plurality of gray scale compensation data, and output one of said first and said second gray scale compensation data according to said third control signal;

a second multiplexer configured to receive a third one and a fourth one of said plurality of gray scale compensation data, and output one of said third and said fourth gray scale compensation data according to said third control signal; and a third multiplexer configured to receive outputs of said first and said second multiplexers and the gray scale data value, and issue the output data selected among the gray scale data value and the outputs of said first and said second multiplexers according to said first and second control signals.

2. The overdriving circuit according to claim 1, wherein said first threshold detection logic unit comprises:

a first comparator configured to compare the gray scale data value with said first predetermined threshold value, and output a first level signal as said first control signal if the gray scale data value is greater than said first predetermined threshold value.

3. The overdriving circuit according to claim 1, wherein said first threshold detection logic unit comprises:

a first comparator configured to compare the gray scale data value with said first predetermined threshold value, and output a second level signal as said first control signal if the gray scale data value is smaller than said first predetermined threshold value.

4. The overdriving circuit according to claim 1, wherein said second threshold detection logic unit comprises:

a second comparator configured to compare the gray scale data value with said second predetermined threshold value, and output a first logical high signal when the gray scale data value is greater than said second predetermined threshold value;

a third comparator configured to compare the gray scale data value with said third predetermined threshold value, and output a second logical high signal when the gray scale data value is smaller than said third predetermined threshold value; and an OR gate configured to receive the outputs of said second and said third comparators, execute a logical OR operation, and output said second control signal.

5. An overdriving circuit for source drivers to overdrive a LCD module, said overdriving circuit comprising:

a first comparator configured to receive a gray scale data value from an overdriving timing controller, compare the gray scale data value with a first predetermined threshold value, and output a first control signal;

a second comparator configured to receive the gray scale data value, compare the gray scale data value with a second predetermined threshold value, and output a first logical high signal when the gray scale data value is greater than said second predetermined threshold value;

a third comparator configured to receive the gray scale data value, compare the gray scale data value with a third predetermined threshold value, and output a second logical high signal when the gray scale data value is smaller than said third predetermined threshold value;

an OR gate configured to receive the outputs of said second and said third comparators, execute a logical OR operation, and output a second control signal; and a selection logic unit configured to receive the gray scale data value and a plurality of gray scale compensation data, and issue an output data selected among the gray scale data value and the plurality of gray scale compensation data according to said first control signal, said second control signal, and a third control signal, wherein said selection logic unit comprises:

a first multiplexer configured to receive a first one and a second one of said plurality of gray scale compensation data, and output one of said first and said second gray scale compensation data according to said third control signal;

a second multiplexer configured to receive a third one and a fourth one of said plurality of gray scale compensation data, and output one of said third and said fourth gray scale compensation data according to said third control signal; and a third multiplexer configured to receive the outputs of said first and said second multiplexers and the gray scale data value, and select one among the gray scale data value and the outputs of said first and second multiplexers according to said first and said second control signals.

6. An overdriving method for source drivers to overdrive a LCD module, said overdriving method comprising:

receiving a gray scale data value from an overdriving timing controller;

comparing the gray scale data value with a first predetermined threshold value, and then outputting a first control signal;

comparing the gray scale data value with a second and a third predetermined threshold values, and then outputting a second control signal, wherein said second control signal is at logical high when the gray scale data value is greater than said second predetermined threshold value or when the gray scale data value is smaller than said third predetermined threshold value, and wherein said second control signal is at logical low when the gray scale data value is within a range between the second and third predetermined threshold value; and according to at least said first, second and third control signals, selecting one data value among the gray scale data value and a plurality of gray scale compensation data as output data, wherein the plurality of gray scale compensation data include first and second gray scale compensation data input to a first multiplexer having a first output, and third and fourth gray scale compensation data input to a second multiplexer having a second output, and the gray scale data value and the first and second outputs are respectively input to a third multiplexer, the step of selecting one data value comprising:

according to the third control signal, selecting one of the first and second gray scale compensation data as the first output from the first multiplexer, and one of the third and fourth gray scale compensation data as the second output from the second multiplexer, respectively; and through the third multiplexer, selecting one among the gray scale data value and the first and second outputs according to the first and second control signals.

7. The overdriving method according to claim 6, wherein a first gray scale compensation data is outputted when said second control signal is at logical high, said first control signal is a first level signal and a third control signal is at logical low.

8. The overdriving method according to claim 6, wherein a second gray scale compensation data is outputted when said second control signal is at logical high, said first control signal is a first level signal and a third control signal is at logical high.

9. The overdriving method according to claim 6, wherein a third gray scale compensation data is outputted when said second control signal is at logical high, said first control signal is a second level signal and a third control signal is at logical low.

10. The overdriving method according to claim 6, wherein a fourth gray scale compensation data is outputted when said second control signal is at logical high, said first control signal is a second level signal and a third control signal is at logical high.

11. An overdriving circuit for source drivers to overdrive a LCD module, said overdriving circuit comprising:

a first comparator configured to receive a gray scale data value from an overdriving timing controller, compare the gray scale data value with a first predetermined threshold value, and output a first control signal as a result of the comparison between the gray scale data value and the first predetermined threshold value;

a second comparator configured to receive the gray scale data value, compare the gray scale data value with a second predetermined threshold value, and output a logical high signal when the gray scale data value is smaller than said second predetermined threshold value;

an OR gate configured to receive the outputs of said first and second comparators, and output a second control signal; and a selection logic unit configured to receive the first and second control signal, a third control signal, the gray scale data value and a plurality of gray scale compensation data, and issue one output data value selected among the gray scale data value and the gray scale compensation data according to said first control signal, said second control signal, and said third control signal, wherein said selection logic unit comprises:

a first multiplexer configured to receive a first one and a second one of said plurality of gray scale compensation data, and output one of said first and said second gray scale compensation data according to said third control signal;

a second multiplexer configured to receive a third one and a fourth one of said plurality of gray scale compensation data, and output one of said third and said fourth gray scale compensation data according to said third control signal; and a third multiplexer configured to receive outputs of said first and said second multiplexers and the gray scale data value, and issue the output data value selected among the gray scale data value and the outputs of said first and said second multiplexers according to said first and second control signals.

12. The overdriving circuit according to claim 11, wherein said third control signal includes a polarization signal.

* * * * *